US006209474B1

(12) United States Patent
Foss et al.

(10) Patent No.: US 6,209,474 B1
(45) Date of Patent: Apr. 3, 2001

(54) TRANSPORTER FOR HEAVY OBJECTS AT SEA

(75) Inventors: Gunnar Foss, Haag (NL); Per Bull Haugsøen, Oslo (NO)

(73) Assignee: Offshore AS, Oslo (NO)

( * ) Notice: Subject to any disclaimer, the term of this patent is extended or adjusted under 35 U.S.C. 154(b) by 0 days.

(21) Appl. No.: 09/331,148

(22) PCT Filed: Dec. 17, 1997

(86) PCT No.: PCT/NO97/00344

§ 371 Date: Aug. 16, 1999

§ 102(e) Date: Aug. 16, 1999

(87) PCT Pub. No.: WO98/26979

PCT Pub. Date: Jun. 25, 1998

(30) Foreign Application Priority Data

Dec. 18, 1996 (NO) ..... 965439
Aug. 1, 1997 (NO) ..... 973563

(51) Int. Cl.[7] ..... B63B 35/40
(52) U.S. Cl. ..... 114/259; 114/125
(58) Field of Search ..... 405/219, 205, 405/206; 114/121, 125, 44, 45, 50, 259

(56) References Cited

U.S. PATENT DOCUMENTS 2,586,966 2/1952 Kuss et al. .
3,054,267 9/1962 Alcorn et al. .
3,633,369 1/1972 Lawrence .
3,859,804 1/1975 Koehler et al. .
4,280,429 * 7/1981 Wells ..... 114/45
4,927,296 5/1990 Kaldenbach .
5,111,764 5/1992 D'Ettorre .

FOREIGN PATENT DOCUMENTS 3219968 12/1983 (DE) .
2005603 * 4/1979 (GB) ..... 114/45
910358 5/1991 (NO) .
9826978 6/1998 (WO) .
9906270 2/1999 (WO) .

* cited by examiner

*Primary Examiner*—Stephen Avila
(74) *Attorney, Agent, or Firm*—Birch, Stewart, Kolasch & Birch, LLP

(57) ABSTRACT

A transporter for heavy objects at sea comprises an oblong structure with a U-shaped cross section and a prismatic enveloping surface, and comprises two long sides, an intermediate underside, an opposite open top side and two short sides. Ballasting chambers are arranged in each of the structure's eight corners which are formed by the points of intersection between the long sides, the underside, the open top side and the short sides, whereby the structure can be rotated by ballasting to a desired position in the water.

20 Claims, 3 Drawing Sheets

TRANSPORTER FOR HEAVY OBJECTS AT SEA

This application is the National phase under 35 U.S.C. § 371 of PCT International Application No. PCT/NO97/00344 which has an International filing date of Dec. 17, 1997

FIELD OF THE INVENTION

The invention concerns a transporter for heavy objects at sea, comprising an oblong structure with a U-shaped cross section and a prismatic enveloping surface, comprising two long sides, an intermediate underside, an opposite open top side and two short sides.

DESCRIPTION OF THE BACKGROUND ART

Heavy objects, such as platform decks, platform jackets and bridge elements are transported by sea on ships or barges. The object is transferred from and to the ship or the barge by hoisting cranes, the object being pushed or pulled, or by means of rolling transport where wheels or rollers are employed.

Another known method is to transfer objects by ballasting the ship or the barge and moving it into a passage under the object, whereupon the ship or the barge is deballasted, thus causing it to be raised and leaving the object lying on the ship or the barge. The object may be unloaded in a similar manner by deballasting the ship or the barge, thus causing it to be lowered, with the object supported by lower-lying supports on the side of the ship or the barge.

These known methods of transporting heavy objects at sea work well as long as the object does not require to be turned, and as long as the level differences which have to be obtained by the ballasting/deballasting are relatively small. When using a ship or a barge, however, it is not possible to turn an object, such as a mast or a platform jacket, which is so large that it has to be transported horizontally, but which has to be turned into a vertical position before being installed in position.

U.S. Pat. No. 5,111,764 describes a method for recovering the substructure of an offshore platform. A floating barge is used comprising a ballastable hull having a deck suitable for receiving the substructure in a substantially horizontal position and including ballastable floats disposed above the deck to right and to left of the intended location for the substructure. The hull and the floats are ballasted so that although it does not sink, the barge moves down into the water and tilts into a position where its deck can be moved against one of the faces of the substructure. The barge is fixed to the substructure, the substructure is disconnected from the sea bed, ballast is removed from the barge to return it to a position where it is floating and carrying the substructure, and the barge is moved to the desired location for unloading the substructure. The invention is applicable to recovering substructures of large dimensions. With the method and barge according to U.S. Pat. No. 5,111,764 it is thereby possible to a certain extent to transport heavy objects at sea, and to turn the object in the water. The degree of attachment and rotational movement which are achieved, however, are limited to the attachment and rotation.

SUMMARY OF THE INVENTION

The object of the invention is to provide a transporter which compared with known devices for transport of heavy objects at sea has greater possibilities for securing the object, and which also has greater possibilities for turning the object in the water.

The object is further to provide a transporter which will also be able to be used for installation or removal of a deck on and from a platform jacket respectively, and installation or removal of a platform jacket on and from the seabed respectively.

The latter object is achieved with a transporter of the type mentioned in the introduction, which, is also characterized by the features which are stated in the claims in the applicant's copending Norwegian patent applications Nos. 973561 and 973562.

The invention therefore includes in a transporter for heavy objects at sea, comprising an oblong structure with a U-shaped cross section and a prismatic enveloping surface, comprising two long sides, an intermediate underside, an opposite open top side and two short sides. In the invention ballasting chambers are arranged in each of the structure's 8 corners which are formed by the points of intersection between the long sides, the undersides, the open top side and the short sides, whereby the structure can be rotated by means of ballasting into a desired position in the water. Moreover, the transporter is provided with attachment means for securing objects which have to be transported.

The ballasting and deballasting are performed in the known manner by pumping water in and out of the ballasting chambers by means of pumps, piping and valves. When the structure is rotated, those ballasting chambers which have to be moved downwards during rotation and after rotation will be located at the bottom are ballasted, while at the same time those ballasting chambers which have to be moved upwards during rotation and after rotation will be located at the top are deballasted. A computer calculates which ballasting chambers have to be ballasted and deballasted in order to achieve the desired rotation and final position of the transporter in the water, while simultaneously calculating the metacentric height and monitoring the progress of the ballasting/deballasting and the rotation. The computer communicates with an operator, who in turn gives orders concerning the execution of the necessary ballasting and deballasting. In this context the information on the metacentric height is very important, since a stable rotation of the transporter, without sudden movements, is dependent on the maintenance of a constant positive metacentric height.

The actual movement of the transporter will be conducted by tugs.

The transporter's ballasting chambers are preferably provided in longitudinal pontoons in the corner areas between the transporter's underside and long sides, and at the top of the long sides. The result is a structure which offers little resistance to movement in the water, and which is consequently suited for transport.

In a preferred embodiment the transporter has attachment means for securing objects, for example in the form of brackets or beams attached to the pontoons.

The above and further preferred embodiments of the invention will be seen in the detailed description.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in more detail in association with a description of specific embodiments, and with reference to the drawings which are given by way of illustration only, and thus are not limitative of the present invention, and, in which.

DETAILED DESCRIPTION OF THE PREFERRED EMBODIMENT

Figure 1:
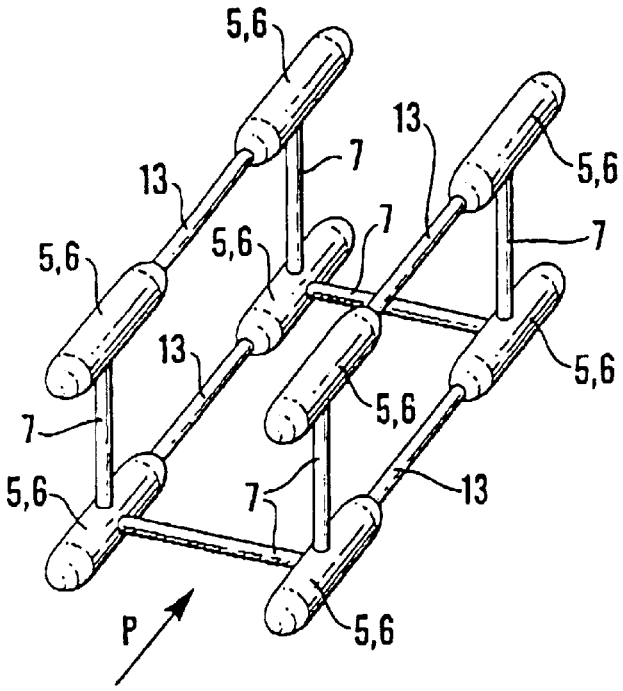
FIG. 1 is a perspective view of a transporter according to the invention.
Figure 2:
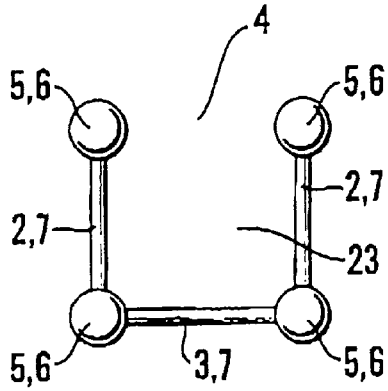
FIG. 2 illustrates the transporter in FIG. 1 viewed from a short side.

FIGS. 1 and 2 elucidate the core of the invention. FIG. 1 illustrates a transporter according to the invention in perspective, and FIG. 2 illustrates the transporter viewed from a short side, in the direction shown by the arrow P in FIG. 1. The transporter in FIGS. 1 and 2 consists of two long sides 2 and an intermediate underside 3, which together form an oblong structure with a U-shaped cross section. The three sides which form the U-shaped cross section together with an open top side 4, which is located opposite the underside 3, and two short sides 23, form a body with a prismatic enveloping surface.

Thus in the illustrated embodiments, the top side 4 and the short sides 23 are only imaginary surfaces or sides. Nor are the long sides 2 and the underside 3 real surfaces, and should be understood as planes which contain structural elements which constitute the transporter according to the invention.

The ballasting chambers 5 are provided in pontoons 6 in each of the transporter's 8 corners, i.e. the 8 corners which are formed by the points of intersection between the surfaces or the sides which form the prismatic enveloping surface. More correct, each of these 8 corners is defined by the intersection between three edgelines which in turn are intersecting lines between adjacent planes or sides in the prismatic body. A structure is thereby formed in which the ballasting chambers 5 are arranged in all the extremities, thereby permitting ballast or buoyancy to be brought to all these extremities.

The transporter in FIGS. 1 and 2 further consists of transverse connecting elements 7 and longitudinal connecting elements 13 which bind the pontoons 6 together. In addition, not shown, the transporter comprises piping, valves, pumps with motors and control equipment for performing the ballasting/deballasting. The ballasting/deballasting is remotely controlled by means of not shown communication equipment. Alternatively, the ballasting/deballasting may be performed with an umbilical which contains both pressurised water for ballasting and pressurised air for deballasting, together with pressurised fluid for operation and control of the valves.

By ballasting or deballasting the various ballasting chambers 5 it is possible to rotate the transporter in FIGS. 1 and 2 into any desired position in the water. Calculations and tests confirm this property of the transporter.

Figure 3:
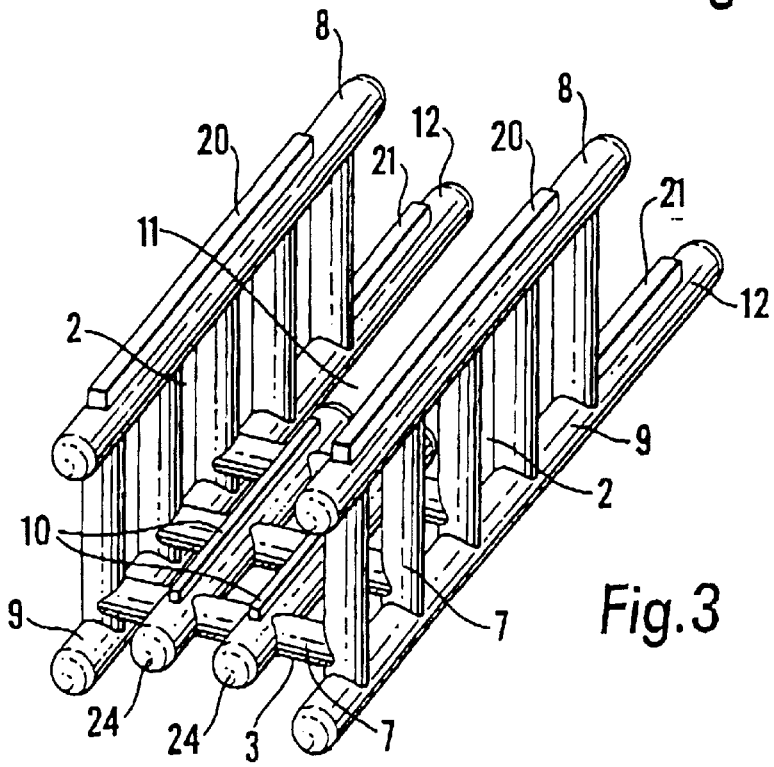
FIG. 3 is a perspective view of a second transporter according to the invention.

FIG. 3 illustrates a transporter which like the transporter in FIGS. 1 and 2 consists of two long sides 2 and an intermediate underside 3 which together form an oblong structure with a U-shaped cross section. Lower longitudinal pontoons 9 are arranged in the longitudinal corner areas between the underside 3 and the long sides 2, and upper longitudinal pontoons 8 are arranged in the upper section of the long sides 2, between the long sides and the imaginary top side. At each end of the longitudinal pontoons 8 and 9 there are arranged ballasting chambers, which are located in one of the corners in the imaginary prismatic enveloping surface around the transporter. In the same way as in FIGS. 1 and 2 the transporter in FIG. 3 forms a structure in which each of the extremities can be ballasted or deballasted, thus making it possible for the structure to be rotated into any desired position in the water.

In the embodiment in FIG. 3 the longitudinal pontoons 8, 9 extend in the entire transporter's longitudinal direction. The ballasting chambers in the transporter's corners may extend from the end of the longitudinal pontoons all the way into the area in the middle of the pontoon, but each pontoon is preferably divided into several chambers. This division into several chambers is performed both in order to achieve a simpler control of the ballasting/deballasting, and to increase the structure's stability in the event of a functional fault or damage to the structure which results in an uncontrolled ballasting or deballasting.

The longitudinal pontoons are preferably composed of tubes or have a tubular cross section, since this is advantageous both with regard to manufacture, internal volume and resistance to internal and external pressure.

Like the transporter illustrated in FIGS. 1 and 2 the transporter illustrated in FIG. 3 has transverse connecting elements 7 provided in the long sides 2 and the underside 3, in order to bind the longitudinal pontoons together. These transverse connecting elements are preferably also composed of ballastable pontoons or tubes, thus enabling them to contribute to the ballasting/deballasting of the transporter.

During transport of the transporter, which is conducted by tugs, it is advantageous to deballast the transporter, so that it offers least possible resistance to motion. In most cases this means that it is advantageous to place the transporter in a position where it is lying with the underside 3 down, as high as possible in the water.

In order to increase the capacity during ballasting/deballasting, and to provide an area for placing objects which are to be transported, the transporter in FIG. 3 comprises two longitudinal pontoons 24 arranged in the transporter's underside 3. In a preferred embodiment, as shown in FIG. 3, these two longitudinal pontoons together with their respective transverse connecting elements 7 are, compared to the surface forming the underside 3, located closer to the transporter's central area. This placing of the longitudinal pontoons 24 and the respective transverse connecting elements 7 has the effect that they are at least partly located above the water when the transporter is lying deballasted in the water with the underside down, with the result that during transport they offer little or no resistance to the movement in the water.

The object which are to be transported can be placed in different locations on the transporter, especially on the underside 3 or the upper longitudinal pontoons 8. In order to obtain easy access for inserting objects which have to be transported to the area above the underside 3, the transporter's short sides are open. This is most clearly illustrated in FIG. 2, where the short side is indicated by reference numeral 23.

In order to secure objects which are to be transported the transporter illustrated in FIG. 3 has attachment means in the form of beams 10 on the longitudinal pontoons in the transporter's underside, beams 20 on the upper longitudinal pontoons, and beams 21 on the lower longitudinal pontoons. The beams 10, 20, 21 may be provided with boltholes for attaching the object by bolting, eyes or lugs for attaching the objects by wives, or other appropriate attachment means.

In order to increase the transporter's usefulness, in the embodiment illustrated in FIG. 3 it has at one end a recess 11, formed due to the fact that the undersides 3 in the longitudinal direction have a shorter extension than the long sides 2. When the transporter is lying in the water with the underside 3 down, the long sides 2 can thereby be moved on the outside of a support for an object which has to be transferred to the transporter. This will be discussed below in more detail with reference to FIG. 5.

Furthermore, in the transporter illustrated in FIG. 3 the lower longitudinal pontoons 9 are longer than the upper longitudinal pontoons 8 at the end in which the recess is located, with the result that the lower longitudinal pontoons have portions or sections 12 which in the longitudinal direction project past the underside 3 and the long sides 2. The lower longitudinal pontoons' outwardly projecting sections 12 contribute to keeping the transporter horizontal when it is lying in the water with the underside down, a ballasting or deballasting or these outwardly projecting sections providing a moment which can counteract the effect of the weight of an object which is placed on the underside 3 or the upper longitudinal pontoons 8.

Figure 4:
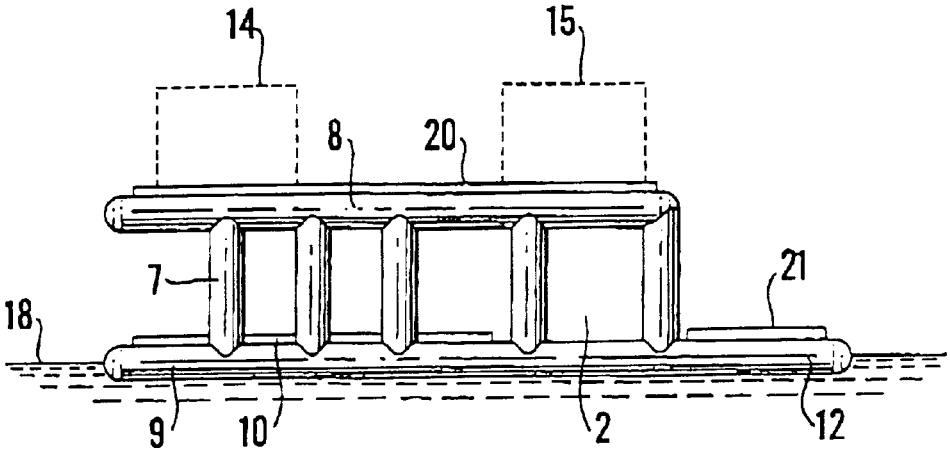
FIG. 4 illustrates a transporter according to the invention, viewed from the side.

FIG. 4 illustrates a transporter according to the invention viewed from the side, located in the water 18. This illustrates how an object 14 can be placed on the upper longitudinal pontoons 8 in an area which in the transporter's longitudinal direction is located opposite the outwardly projecting sections 12 of the lower longitudinal pontoons 9. This placing of the object 14 will attempt to turn the transporter, thus raising the end where the outwardly projecting sections 12 are located. In order to counteract this the outwardly projecting sections 12 can be ballasted. Similarly, a placing of an object 15 at the end of the transporter where the outwardly projecting sections 12 are located will attempt to turn this end down into the water 18, which can be counteracted by a deballasting of the outwardly projecting sections 12.

Figure 5:
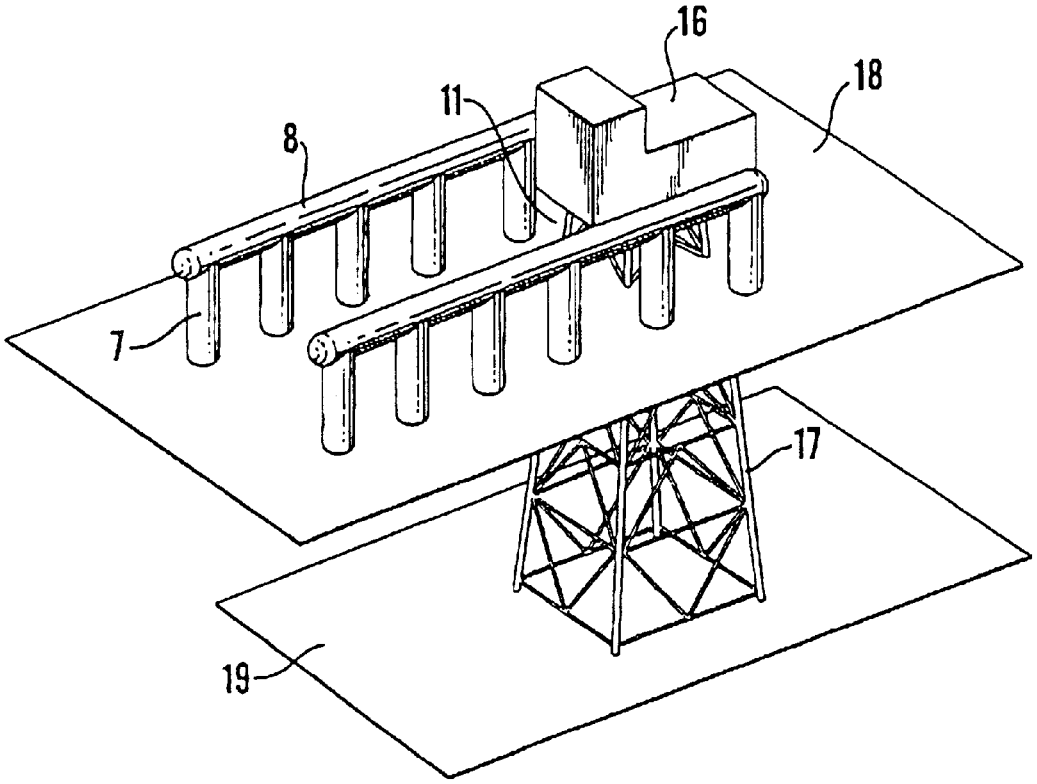
FIG. 5 illustrates a tansporter according to the invention in use during a lifting/transport operation at sea.

FIG. 5 illustrates a transporter according to the invention in use during a lifting/transport operation at sea. Here the transporter is lying with the lower pontoons 9 under the water 18, and the long sides have been moved on to the outside of a platform jacket 17 which is standing on the seabed 19. The platform jacket is located in the recess 11 in the underside 3, which is not shown, since the underside is located down in the water. Attachment means in the form of supporting sections on the transporter's long side have been brought into abutment against a platform deck 16 which rests on the jacket 17. When the transporter is deballasted it will be raised in the water, thereby enabling the deck 16 to be lifted from the jacket 17, and taken away by means of the transporter.

FIGS. 6 *a–h* illustrate a sequence in which the transporter in FIG. 4 is used to transport and install a bridge element. In FIG. 6*a* a transporter 1 is lying horizontally in the water 18, beside a bridge element 30. The bridge element 30 is resting on two supports 31, a front support and a rear support indicated by dotted lines. It should be understood that the rear support is located behind the front support, and that the bridge element 30 in the direction perpendicular to the transporter's longitudinal direction has an extension which is larger than the transporter's width. Further, between the supports 31 there is a recess which is sufficiently wide and deep to contain the transporter 1.

Figure 6A:
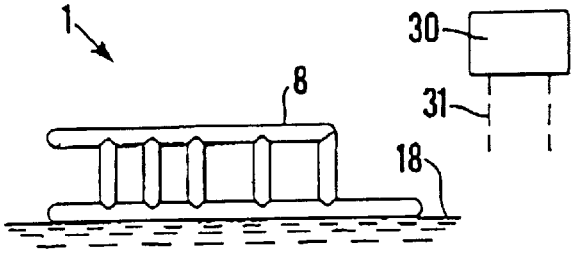
FIGS. 6*a–h* illustrate a sequence in which the transporter in FIG. 4 is used to install a bridge element.
Figure 6B:
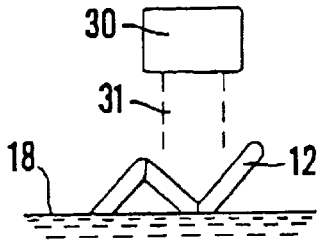

FIG. 6*b* illustrates the transporter in a position where it is so ballasted that it has sunk down in the water under the bridge element 30, and is partially rotated into a position where it can lift the bridge element.

Figure 6C:
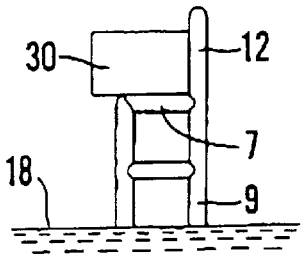

FIG. 6*c* illustrates the transporter in a vertical position, where it has lifted the bridge element off the supports, so that the bridge element is resting on the outwardly projecting sections 12 of the lower pontoons 9 and a cross element 7.

Figure 6D:
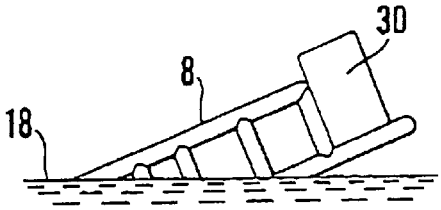
Figure 6E:
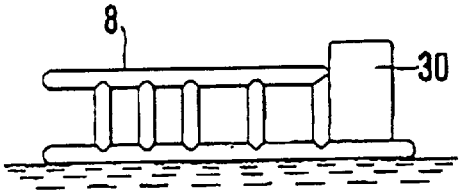

FIGS. 6*d* and 6*e* illustrate the transporter with the bridge element during and after rotation to a horizontal position in the water respectively, for transport to a destination.

Figure 6F:
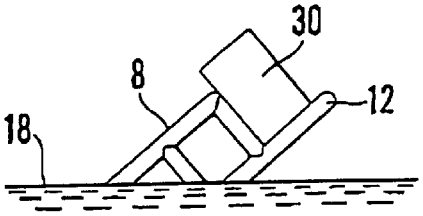
Figure 6G:
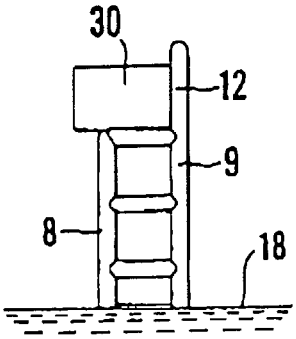

FIG. 6*f* illustrates the transporter during rotation to a vertical position after arrival at the destination, and FIG. 6*g* shows the transporter in a vertical position, raised to the correct height for transfer of the bridge element.

Figure 6H:
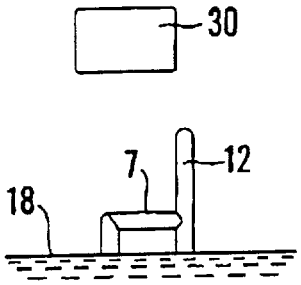

FIG. 6*h* illustrates the bridge element transferred from the transporter, as it should be understood that the bridge element is attached to not shown adjacent bridge elements or bridge foundations. After the transfer the transporter is lowered into the water and removed.

Compared to the introductory known device, represented by Norwegian patent application No. 91 0358, the transporter according to the invention therefore provides greater possibilities for securing the object, and greater possibilities for turning the object in the water. Thus the transporter according to the invention fulfils the object of the invention.

Further advantageous embodiments and applications of the transporter, associated with removal of a platform deck from a jacket, and removal of a jacket from the seabed, are illustrated and described in the applicant's copending Norwegian patent applications Nos. 973561 and 973562. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transporter for heavy objects at sea, comprising:

an oblong structure with a U-shaped cross section and a prismatic enveloping surface having eight corners, the oblong structure having two long sides, an intermediate underside, an opposite open top side and two short sides;

ballasting chambers being provided in each of the eight corners of the prismatic enveloping surface, whereby the structure can be rotated by ballasting to a desired position in water; and attachment means for securing objects which are to be transported to the transporter.

2. The transporter according to claim 1, wherein the ballasting chambers in the corners of the prismatic enveloping surface are provided in ballastable pontoons arranged in four longitudinal corner areas between the long sides, the underside and the open top side of the structure, the structure further comprising transverse connecting elements provided in the long sides and underside for connecting the pontoons together.

3. The transporter according to claim 2, wherein the pontoons in the longitudinal corner areas include longitudinal pontoons.

4. The transporter according to claim 3, wherein the longitudinal pontoons in the longitudinal corner areas extend along an entire longitudinal direction of the transporter and have a ballasting chamber at each end, which ballasting chambers in the longitudinal direction are extendable towards the middle of the pontoon.

5. The transporter according to claim 1, wherein the underside has at least one longitudinal pontoon.

6. The transporter according to claim 5, wherein at least one of the longitudinal pontoons, compared to a surface forming the underside, is located closer to a central area of the transporter such that when the transporter is lying in the water with the underside down, the at least one longitudinal pontoon in the underside is located at least partly above the water.

7. The transporter according to claim 1, wherein the transporter is open in at least one of the short sides to thereby provide easy access for objects which are to be placed in an area above the underside.

8. The transporter according to claim 1, wherein one end of the underside has a recess formed due to the underside in the longitudinal direction of the transporter has a shorter extension than the long sides, whereby when the transporter is lying in the water with the underside down, the long dies can be moved on to the outside of a support for an object which is to be transferred to the transporter.

9. The transporter according to claim 8, wherein the pontoons in the longitudinal corner areas include longitudinal pontoons and wherein the longitudinal pontoons between the underside and the long sides at an end of the transporter adjacent the recess have projecting sections which project past the long sides in the longitudinal direction whereby when at least a portion of the pontoons are deballasted, the projecting sections contribute to keeping the transporter horizontal when lying in the water with the underside down and further support an object at the same end of the transporter.

10. The transporter according to claim 3, wherein the longitudinal pontoons between the underside and the long sides have projecting sections which project past the long sides in the longitudinal direction whereby when at least a portion of the pontoons are deballasted, the projecting sections contribute to keeping the transporter horizontal when lying in the water with the underside down and further support an object at the same end of the transporter.

11. The transporter according to claim 3, wherein the longitudinal pontoons are composed of tubes.

12. The transporter according to claim 2, wherein the transverse connecting elements in the long sides and underside of the transporter are composed of at least one of pontoons and tubes.

13. The transporter according to claim 12, wherein the at least one of pontoons and tubes are ballastable.

14. The transporter according to claim 1, wherein the oblong structure is made from hollow tubes.

15. A method for at least transporting heavy objects at sea, the method comprising the steps of:

providing an oblong structure with a U-shaped cross section and a prismatic enveloping surface having eight corners, the oblong structure having two long sides, an intermediate underside, an opposite open top side and two short sides;

rotating the structure to any desired position in the water by ballasting and deballasting selected ballasting chambers, each of the eight corners of the prismatic enveloping surface having at least one of the ballasting chambers; and attaching at least one object to be transported to the transporter after the step of rotating.

16. The method for transporting heaving objects at sea according to claim 15, further comprising the steps of:

bringing the transporter into abutment with a jacket supporting the at least one object to be transported; and lifting the at least one object from the jacket during the step of rotating to thereby detach the at least one object from the jacket.

17. The method for transporting heaving objects at sea according to claim 15, wherein the at least one object is a platform deck and wherein the method further comprises the step of moving the platform through the sea on the transporter.

18. A portion of a disassembled offshore platform including at least one of the jacket and platform produced in accordance with the steps of claim 17.

19. A portion of a disassembled offshore platform including a jacket produced in accordance with the steps of claim 16.

20. A portion of a disassembled offshore platform including at least one object produced in accordance with the steps of claim 15.

* * * * *